US005578894A

United States Patent [19]

Oshima

[11] Patent Number: 5,578,894

[45] Date of Patent: Nov. 26, 1996

[54] SPARK PLUG FOR USE IN INTERNAL COMBUSTION ENGINE

[75] Inventor: Takafumi Oshima, Nagoya, Japan

[73] Assignee: NGK Spark Plug Co., Ltd., Nagoya, Japan

[21] Appl. No.: 411,077

[22] Filed: Mar. 27, 1995

Related U.S. Application Data

[63] Continuation of Ser. No. 35,703, Mar. 23, 1993, abandoned.

[30] Foreign Application Priority Data

Mar. 24, 1992 [JP] Japan ..... 4-065791
Jan. 11, 1993 [JP] Japan ..... 5-002881

[51] Int. Cl.[6] ..... H01T 13/20

[52] U.S. Cl. ..... 313/141; 313/11.5; 445/7

[58] Field of Search ..... 313/11.5, 141; 445/7; 123/169 EL; 419/9

[56] References Cited

U.S. PATENT DOCUMENTS

| | | | |
|---|---|---|---|
| 3,892,216 | 7/1975 | Danis | 123/286 |
| 4,093,887 | 6/1978 | Corbach et al. | 313/140 |
| 4,314,392 | 2/1982 | Waite | 445/7 |
| 4,400,643 | 8/1983 | Nishio et al. | 313/11.5 |
| 4,514,657 | 4/1985 | Igashira et al. | 313/130 |
| 4,585,421 | 4/1986 | Payne | 445/7 |
| 4,606,730 | 8/1986 | Kin et al. | 445/7 |
| 4,695,759 | 9/1987 | Podiak | 313/136 |
| 4,808,135 | 2/1989 | Sakura et al. . | |
| 4,814,665 | 3/1989 | Sakura et al. | 313/141 |
| 4,967,116 | 10/1990 | Oshima | 313/141 |
| 5,017,826 | 5/1991 | Oshima et al. | 313/142 |
| 5,107,169 | 4/1992 | Schneider et al. | 313/141 |
| 5,273,474 | 12/1993 | Oshima et al. | 445/7 |
| 5,292,477 | 3/1994 | Chance et al. | 419/9 |
| 5,310,373 | 5/1994 | Treiber et al. | 445/7 |
| 5,347,193 | 9/1994 | Oshima et al. | 313/141 |

FOREIGN PATENT DOCUMENTS

| | | | |
|---|---|---|---|
| 61-143973 | 7/1986 | Japan | H01T 13/39 |

OTHER PUBLICATIONS

NK6 Spark Plug "Ignition Plug For Internal Combustion Engines" 1986, Abstract.
Database WPI, Week 8632.

*Primary Examiner*—Brian Zimmerman
*Assistant Examiner*—Lawrence O. Richardson
*Attorney, Agent, or Firm*—Sughrue, Mion, Zinn, Macpeak & Seas

[57] ABSTRACT

In a spark plug having a center electrode and an outer electrode, at least one of which is made of a nickel-alloyed clad and a thermally conductive copper-alloyed core embedded in the nickel-alloyed clad, the copper-alloyed core includes an additive metal which forms a supersaturated solid solution with a copper metal in which the additive metal or an intermetallic compound is precipitated from the copper phase, and substantially evenly dispersed.

2 Claims, 12 Drawing Sheets

*1 heat value corresponding to spark plug No.5

*2 heat value corresponding to spark plug No.4

SPARK PLUG FOR USE IN INTERNAL COMBUSTION ENGINE

This is a Continuation of application Ser. No. 08/035,703 filed Mar. 23, 1993, now abandoned.

BACKGROUND OF THE INVENTION

1. Field of the Invention

This invention relates to a spark plug having a center electrode and an outer electrode, at least one of which is made of a nickel-alloyed clad and a thermally conductive copper-alloyed core embedded in the nickel-alloyed clad.

2. Description of Prior Art

In a spark plug for use in internal combustion engine, a center electrode is made of a nickel clad and a copper core embedded in the nickel clad. When the engine runs repeatedly between full throttle and idle operation, the composite electrode is exposed to a huge temperature differential environment so that the nickel clad plastically deforms due to the thermal stress caused from the thermal expansional difference between the nickel clad and the copper core. The increased thermal stress causes to unfavorably deform the center electrode. The degree of the deformation depends upon the growth of void developed in the copper core. The relationship with the void is such that the fully grown void accelerates the deformation of the nickel clad of the center electrode.

FIG. 11*a* shows how the center electrode 110 deforms depending upon the void 130 grown in the copper core 120*c* embedded in the nickel clad 120*n* due to the repeated thermal stress. The grown void 130 causes to radially expand and axially contract the center electrode 110 from the phantom line position to the solid line position.

When the engine alternately runs 6000 cycles between 5000 rpm full throttle for one minute and idling operation for one minute, the center electrode 110 further undergoes the repeated thermal stress to continue expanding radially so as to finally develop cracks 140*c* in an insulator 140 as shown in FIG. 11*b*.

Meanwhile, when the composite structure of nickel clad 160*n* and copper core 160*c* is applied to an outer electrode 150, voids 170 grows in a copper core 160*c* due to the thermal expansional difference between the nickel clad 160*n* and the copper core 160*c*. As shown by the phantom line in FIG. 12, the fully grown voids deform the outer electrode 150 away from a front end 151*a* of a center electrode 151.

As understood from the above description, the deformation of the two electrodes 110, 150 is due to the voids 130, 170 grown in the copper core 120*c*, 160*c*. It is, therefore, necessary to control the growth of these voids to prevent the deformation of the electrodes.

For this reason, various types of copper-based alloy has been investigated, and a number of patent applications have been filed and Patent Provisional Publication Nos. 61-143971, 61-143972, 61-143973, 61-148788, 61-148789, 61-148790 and 4-065791.

Among these patent applications, the laying-open patent application No. 61-143973 discloses a copper-alloyed core containing an element or elements in the range of 0.03–1.0 weight percentages selected from the group consisting of Ti, Zr and Cr.

All these patent applications are intended to select specific elements to add them to the copper core in a certain percentage range, and none of the patent applications discloses how the selected elements used for what purpose.

Adding the specific elements to the copper core usually deteriorates its thermal conductivity rapidly. When the elements are added to the copper core to prepare a copper-alloyed core so as to employ it to a center electrode or an outer electrode, the thermal conductivity of the two electrodes reduces, and thus making it impossible to control the development of the void and to prevent the growth of the void. In general, the copper-alloyed core deteriorates a preignition resistant property when it is used for the center electrode. The copper-alloyed core usually causes to readily oxidize the nickel clad in a high temperature environment so as to deteriorate a spark-erosion resistant property when used for the outer electrode.

Therefore, it is an object of the invention to provide a copper-alloyed core which is capable of holding fine grain size in high temperature so as to prevent voids readily developed in the grain boundary, and holding a good thermal conductivity and a good physical strength in high temperature. By employing the copper-alloyed core to the center and outer electrodes, the preignition resistant property of the spark plug is enhanced to contribute to its extended service life.

SUMMARY OF THE INVENTION

According to the invention, the copper-alloyed core includes an additive metal which forms a supersaturated solid solution with a copper metal in which the additive metal or an intermetallic compound is precipitated from the copper phase, and substantially evenly dispersed.

The copper-alloyed core is such that its physical strength is enhanced in high temperature to maintain the grains of the additive metal minute by holding fine grain size in high temperature so as to prevent voids readily developed in the grain boundary when undergoing the repeated thermal stress due to the huge temperature difference. For this reason, it is possible to prevent the unfavorable deformation of the electrodes to contribute to its extended service life.

Due to the fact that the additive metal or an intermetallic compound is precipitated from the copper phase, an amount of the additive metal melted in the copper phase is insignificantly small so as to substantially maintain the intrinsic thermal conductivity of the copper. The copper-alloyed core significantly improves the preignition resistant property when it is used for the center electrode on the one hand. On the other hand, the copper-alloyed core prevents the nickel clad from readily being oxidized in the high temperature environment so as to enhance the spark-erosion resistant property when used for the outer electrode.

With a slight addition of chromium (Cr) and zirconium (Zr), the copper-alloyed core is improved in its physical strength and thermal conductivity in high temperature.

The additive metal of less than 0.5 weight percentages makes an amount of the supersaturated solid solution small, thus making it difficult to improve the physical strength of the copper-alloyed core so as to make the grains coarse to develop the void and facilitate its growth.

The additive metal exceeding 1.5 weight percentages significantly deteriorates the thermal conductivity of the copper-alloyed core.

When the grain size of the supersaturated solid solution precipitated from the copper phase exceeds 10 μm, it is difficult to maintain the physical strength of the copper-alloyed core. In order to compensate for the difficulty, it is necessary to minutely disperse the supersaturated solid solution evenly in the copper-alloyed core.

From the reason that the thermal conductivity of the copper-alloyed core is 200 W/m.k or more when measured at the normal temperature by a laser-flash method, the center electrode is enhanced in its heat conductivity so as to help improve the preignition resistant property. At the same time, the thermal conductivity of 200 W/m.k or more helps prevent the nickel clad from being readily oxidized in the high temperature environment so as to improve the spark-erosion resistant property.

From the reason that the copper-alloyed core includes a ceramic powder substantially evenly dispersed in a copper metal in the range of 0.2–1.5 weight percentages, the copper-alloyed core is improved in its mechanical strength without losing the good intrinsic thermal conductivity of the copper. The ceramic powder of less than 0.2 weight percentages makes it insufficient to impart the mechanical strength to the copper-alloyed core. On the other hand, the ceramic powder exceeding 1.5 weight percentages significantly reduces the thermal conductivity of the copper-alloyed core.

When the composite structure of the nickel clad and copper-alloyed electrode is used for at least one of the center electrode and the outer electrode of the spark plug, the preignition resistant property of the spark plug is enhanced to contribute to its extended service life.

These and other objects and advantages of the invention will be apparent upon reference to the following specification, attendant claims and drawings.

DETAILED DESCRIPTION OF THE EMBODIMENTS

Figure 1:
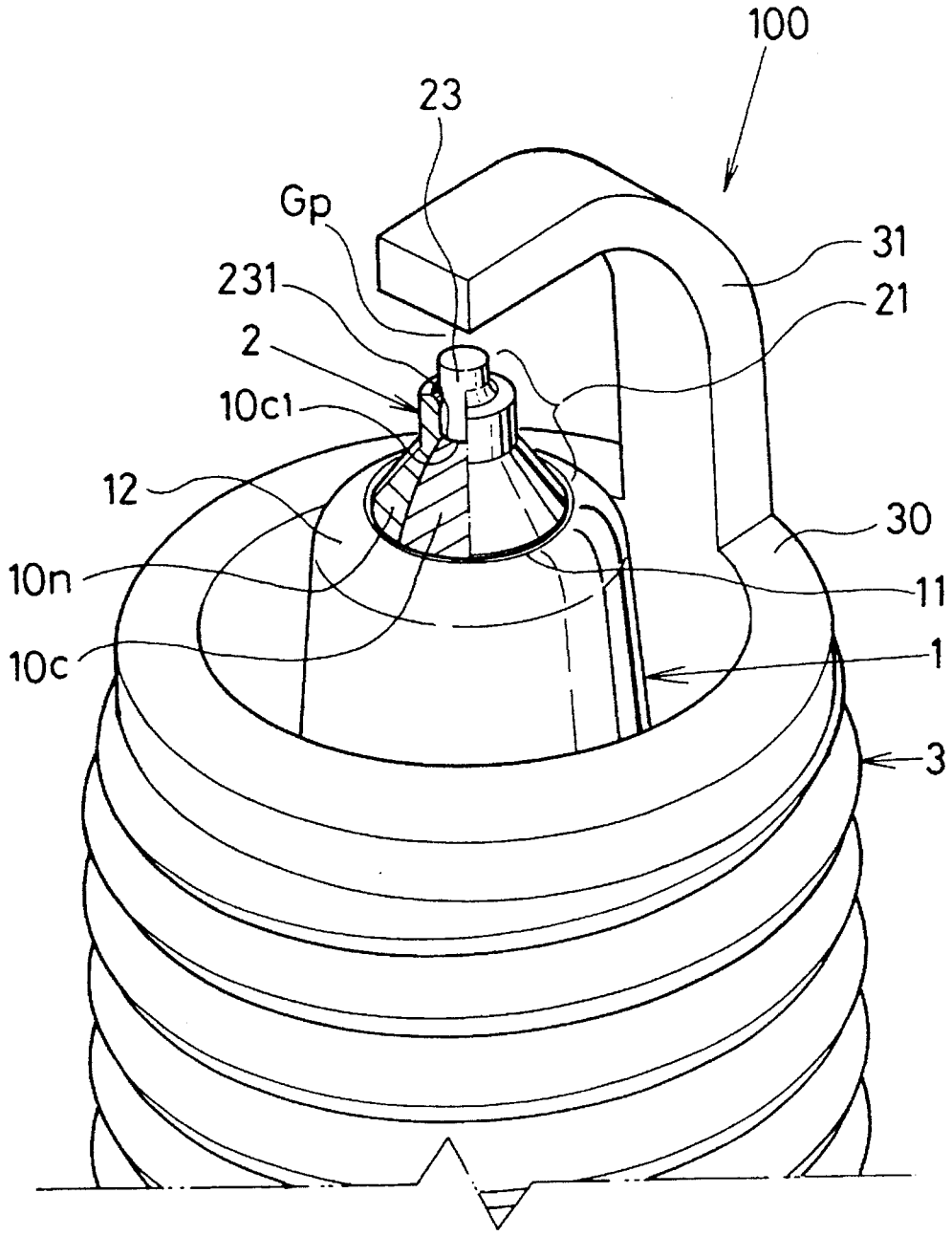
FIG. 1 is an enlarged perspective view of a main part of a spark plug according to an embodiment of the invention.
Figure 2:
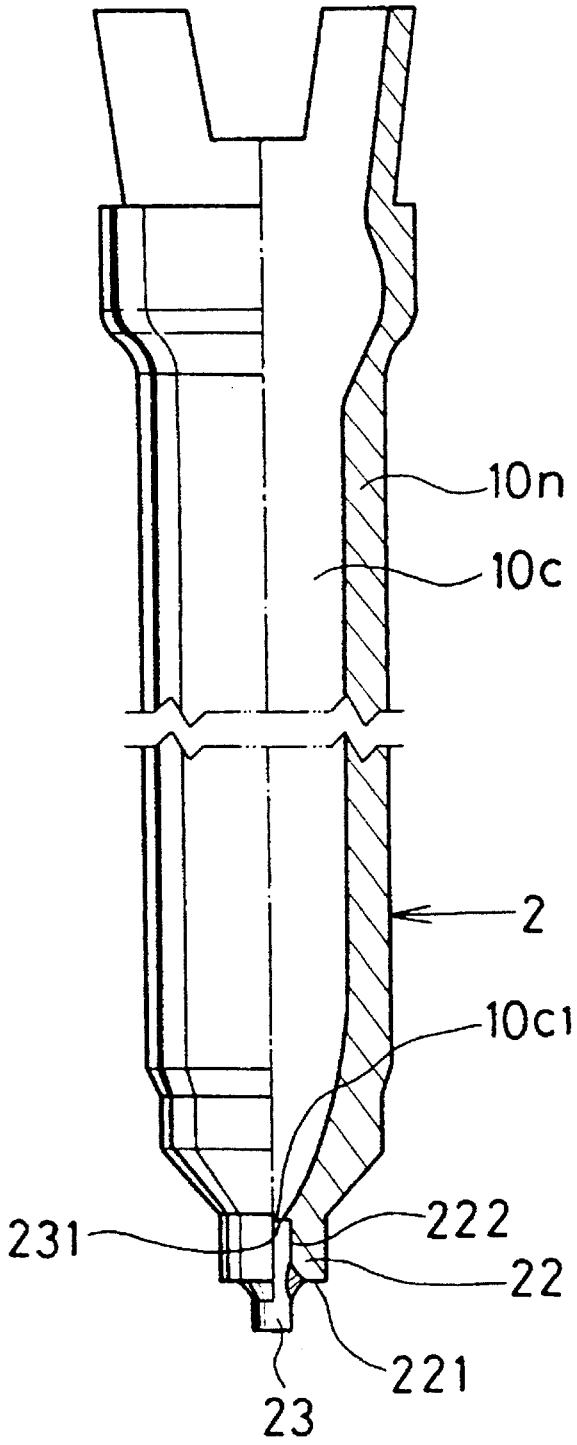
FIG. 2 is a plane view of a center electrode, but its right half portion is longitudinally sectioned.
Figure 8:
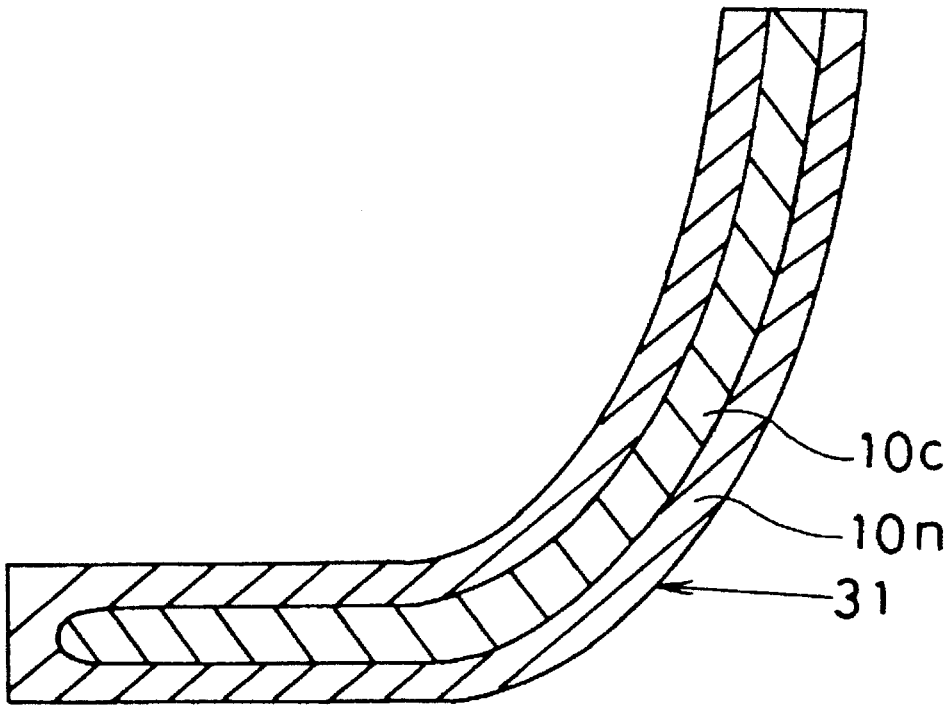
FIG. 8 is a longitudinal cross sectional view of an outer electrode.

Referring to FIG. 1 which shows a main part of a spark plug 100 according to an embodiment of the invention, the spark plug 100 has a metallic shell 3 in which a tubular insulator 1 is supportedly placed, an inner space of which serves as an axial bore 11. Within the axial bore 11, is a center electrode 2 placed which has a front end 21 somewhat extended beyond a front end 12 of the insulator 1. An L-shaped outer electrode 31 is fixedly welded to a front end surface 30 of the metallic shell 3 so as to form a spark gap (Gp) with a firing tip 23 as described hereinafter. These two electrodes 2, 31 are made of a composite configuration including a nickel-alloyed clad 10*n* and a copper-alloyed core 10*c* embedded in the nickel-alloyed clad 10*n* as shown in FIGS. 2 and 8.

The nickel-alloyed clad 10*n* is an Inconel (trademark) superior in high temperature oxidation resistant property. The copper-alloyed core 10*c* contains an additive metal or metals in the range of 0.5–1.5 weight percentages selected from the group listed at Table 1, but the core 10*c* always contains at least one of chromium (Cr) and zirconium (Zr). These additive metals form a supersaturated solid solution with a copper metal, and precipitated from the copper phase, and substantially dispersed evenly in the supersaturated solid solution. Specimens raised in Table 1 relate to the embodiment of the invention except specimens A, C, L, P, Q and R.

Figure 3A:
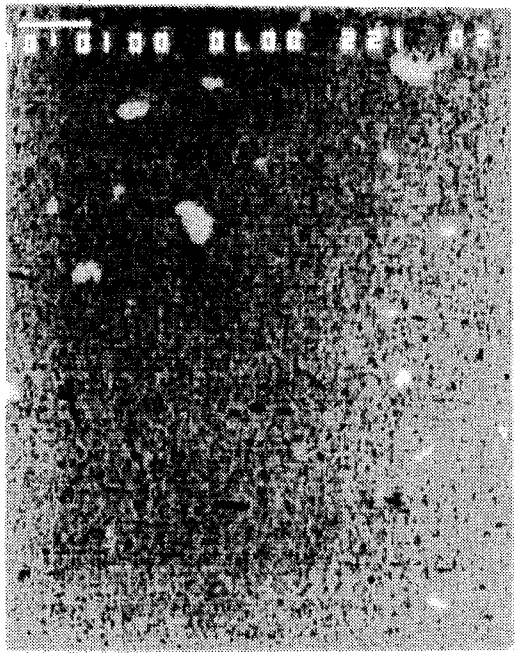
FIGS. 3*a*, 3*b* and 3*c* are microscopic photographs of texture according to a specimen H in Table 1.
Figure 3B:
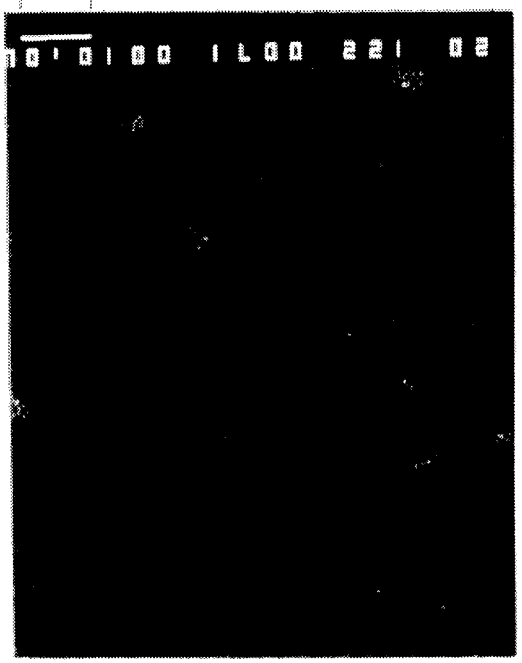
Figure 3C:
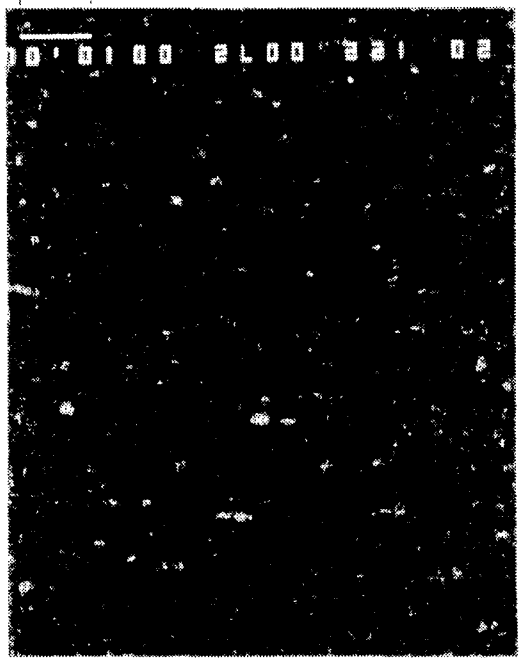

FIGS. 3*a*–3*c* are texture photographs (1000×) of the specimen H. FIG. 3*b* indicates Zr in FIG. 3*a*, while FIG. 3*c* points Cr in FIG. 3*a* as analysed by blank dots.

TABLE 1

| | | center electrode | | | | | | | | | | | | | | |
|---|---|---|---|---|---|---|---|---|---|---|---|---|---|---|---|---|
| | | additive metal (wt %) | | | | | | | | | | | thermal conductivity at normal temp. | number of heat cycles necessary to contact by 0.1 mm | whether void develops at 1000 heat cycles | precipitation-hardened type copper metal |
| | | Cr | Zr | Si | Ti | Be | Ni | Co | Al | Fe | Sn | Zn | | | | |
| specimen | A | 0.3 | | | | | | | | | | | 370 | 1700 | developed | — |
| | B | 0.5 | | | | | | | | | | | 350 | 3500 | not developed | ○ |
| | C | 0.3 | 0.1 | | | | | | | | | | 360 | 1800 | developed | ○ |
| | D | 0.35 | 0.15 | | | | | | | | | | 350 | 3500 | not developed | ○ |
| | E | 0.35 | 0.15 | | 0.3 | | | | | | | | 140 | 3700 | not developed | ○ |
| | F | 0.6 | 0.2 | | | | | | | | | | 300 | 3800 | not developed | ○ |
| | G | 0.85 | 0.15 | 0.05 | | | | | | | | | 330 | 4000 | not developed | ○ |
| | H | 1.0 | 0.2 | | | | | | | | | | 280 | 4000 | not developed | ○ |
| | I | 1.0 | | | | | | | | | | | 280 | 4000 | not developed | ○ |
| | J | 1.1 | 0.25 | | | | | | | | | | 250 | 4000 | not developed | ○ |
| | K | 1.2 | 0.2 | | 0.1 | | | | | | | | 150 | 4500 | not developed | ○ |
| | L | 1.5 | 0.2 | | | | | | | | | | 180 | 5000 | not developed | ○ |
| | M | 0.6 | 0.2 | | | 0.1 | | | | | | | 270 | 3800 | not developed | ○ |
| | N | 0.6 | 0.2 | | | | 0.1 | | | | | | 270 | 3800 | not developed | ○ |
| | O | 0.6 | 0.2 | | | | | 0.1 | | | | | 270 | 3800 | not developed | ○ |
| | P | | | | | | | | | 1 | 0.5 | 0.5 | 240 | 1800 | developed | ○ |
| | Q | | | | | | | | 0.3 | | | | 220 | 1500 | developed | — |
| pure copper | R | | | | | | | | | | | | 390 | 1000 | developed | |

The copper-alloyed core 10*c* is manufacture as follows:

(1) The additive metals are added to a pure copper in accordance with the weight percentages listed by Table 1, and melted in unoxidized atmosphere.

(2) The melted alloy is casted to form cylindrical ingot (about 200 mm diameter), and this ingot is cutted suitable length (about 400–500 mm) to heat about 900° C. for hot extrusion and it extruded to form a coil.

(3) After heating this coil alloy to 950°–980° C., the coil alloy is forcibly water cooled to precipitate the supersaturated solid solution in which each of the additive metals is dispersed evenly. In this instance, each precipitated particle size of the additive metals is less than 10 μm.

And another manufacture is as follows. After assembling the coil alloy in to the electrodes 2, 31, center electrode may be heated to 950°–960° C. at glass sealing process. Then, the coil alloy of electrode may be forcibly cooled by means of water or argon gas.

Figure 4:
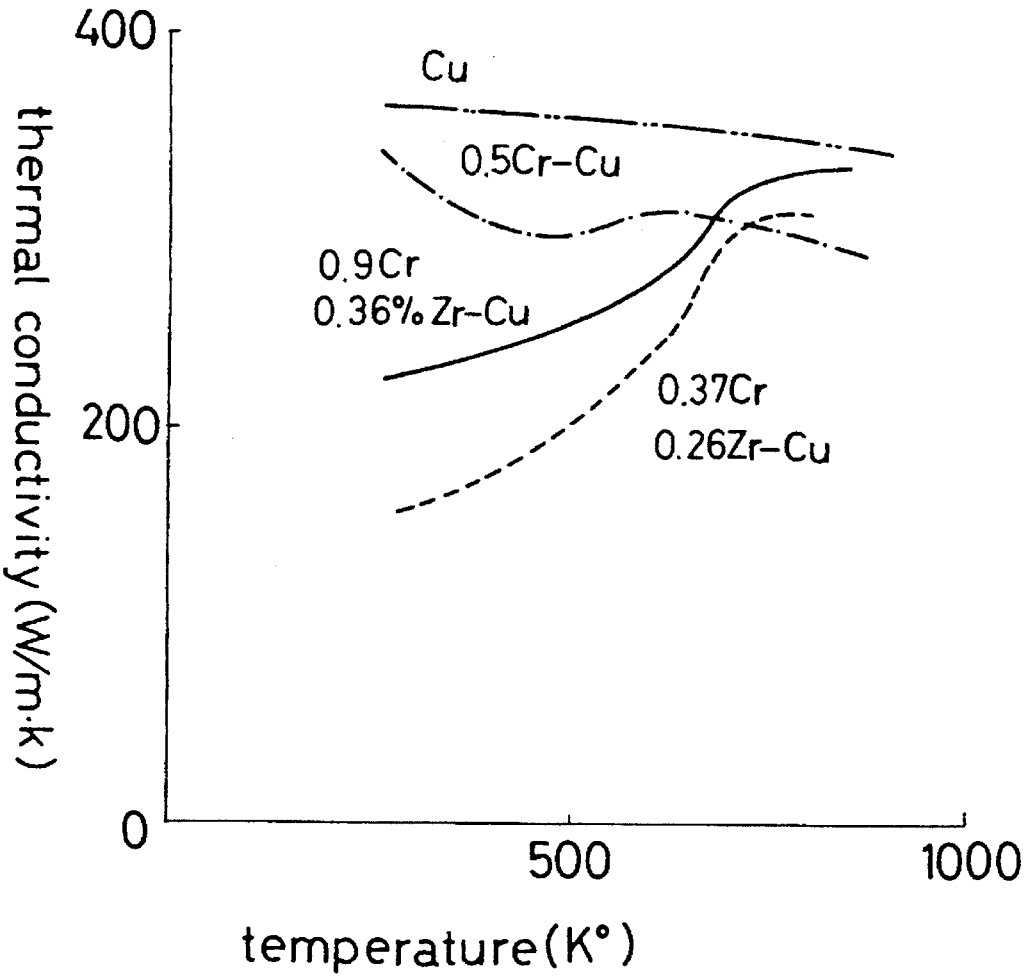
FIG. 4 is a graph showing how the relationship between the temperature (K°) and thermal conductivity (W/m.k) changes depending on an amount of chromium (Cr) and zirconium (Zr) added to the copper-alloyed core.

FIG. 4 is a graph showing how a relationship between the temperature (K°) and thermal conductivity (W/m.k) changes by slightly adding Cr, Zr (0.26–0.9 wt %) to the pure copper. It is found that adding Cr, Zr to the pure copper improves the thermal conductivity of the copper-alloy with the increase of the temperature although the thermal conductivity of the pure copper per se decreases as the temperature rises.

Figure 5:
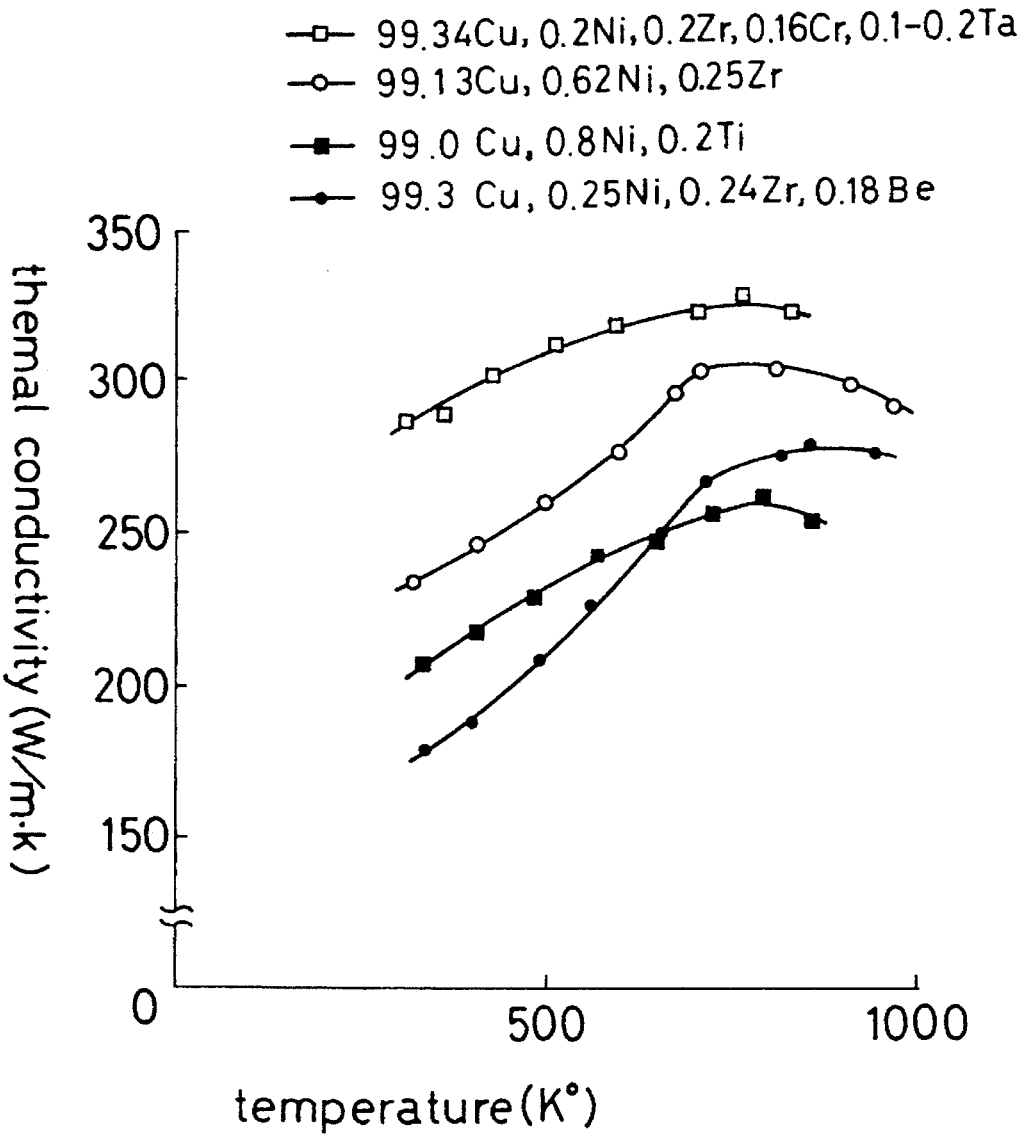
FIG. 5 is a graph showing how the relationship between the temperature (K°) and thermal conductivity (W/m.k) changes depending on an amount of various types of metals added to the copper-alloyed core.

FIG. 5 is a graph showing how a relationship between temperature (K°) and thermal conductivity (W/m.k) changes by slightly adding Cr, Zr, Ni, Ti, Be and Ta alone or appropriate combination to the pure copper. It is found that adding Ni, Ti, Be, Ta and Co to the pure copper also proves effective in improves the thermal conductivity of the copper-alloy.

Thus the thermal conductivity of the copper-alloy core 10*c* is improved by precipitating Cr, Zr and dispersing them evenly in the supersaturated solid solution. By assembling :the copper-alloyed core 10*c* to the center electrode 2, it enables to prevent the front end of the center electrode 2 from excessively heated. This avoids occurrences of preignition in which an air-fuel mixture gas is prematurely ignited at the stroke of compression because of the excessively heated front end of the center electrode.

In another embodiment of the invention, a copper-based core is made by uniformly dispersing ceramic powder such as alumina ($Al_2O_3$) or magnesia (MgO) in the pure copper metal. The weight percentages of the ceramic powder is in the range of 0.2–1.5 as shown in Table 2. Within the copper-based core, the ceramic powder is present in the form of particles, thus making it possible to increase the mechanical strength at high temperature without losing the thermal conductivity. For this reason, the copper-based core is appropriate for the center electrode 2.

TABLE 2

| copper-based core | thermal conductivity at normal temp. |
|---|---|
| Cu-0.5% MgO | 334 |
| Cu-0.5% MgO | 330 |
| Cu-0.5% MgO | 324 |
| Cu-2.0% MgO | 316 |
| Cu—BeO | 340 |
| Cu-2.5% $Al_2O_3$ | 312 |

Figure 6:
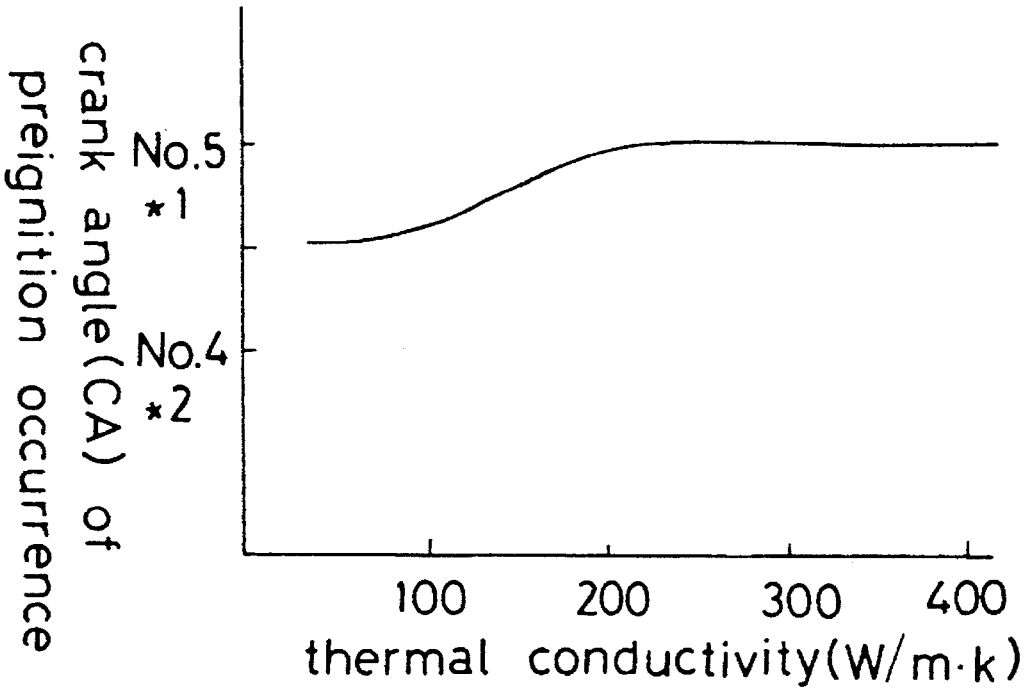
FIG. 6 is a graph showing the relationship between the thermal conductivity (W/m.k) and a crank advancement angle of preignition occurrence.

FIG. 6 is a graph showing a relationship between the thermal conductivity (W/m.k) and the crank angle (CA) of the preignition occurrence. The graph indicates that the preignition occurrence decreases so long as the thermal conductivity of the copper-alloyed core 10*c* is 200 W/m.k or more when measured at the normal temperature (20° C.) by the laser-flash method. The thermal conductivity of the specimens in Table 1 represents 200 W/m.k or more except for the specimens E, K and L.

In the precipitation-hardened type copper specimens B and D–O listed in Table 1, the additive metals are precipitated from the copper phase, and evenly dispersed individually in the form of a single metal or intermetallic compound. For this reason, the copper-alloyed core 10*c* is improved in its mechanical strength in high temperature, and the metallic grains are maintained minute without getting coarse. When these specimens B and D–O are incorporated into the center electrode 2, it is found that substantially no void is developed in the copper-alloyed core 10*c* after carrying out an endurance test with the spark plug mounted on a six-cylinder, 2000 cc engine which runs 1000 cycles alternately at 6000 rpm with full throttle for one minute and idle operation for one minute. It takes 3500–4000 cycles to axially contract the center electrode 2 by 0.1 mm, thus making it difficult to deform the center electrode 2 to contribute to its extended service life.

The specimens B, D, F, G, H, I, J, M, N and O have superior properties in which no void is perceived in the copper-alloyed core 10*c*, and its thermal conductivity represents 200 W/m.k or more when the heat cycles subjected to the specimens exceeds 1000.

Figure 7A:
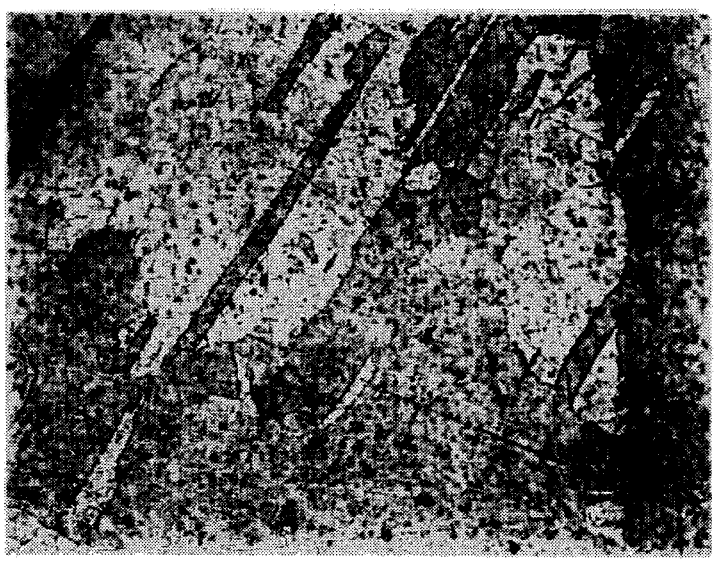
FIGS. 7*a* and 7*b* are microscopic photographs of texture of specimens G and Q obtained after carrying out an endurance test with the spark plug mounted on the engine which runs at full throttle and high speed operation.
Figure 7B:
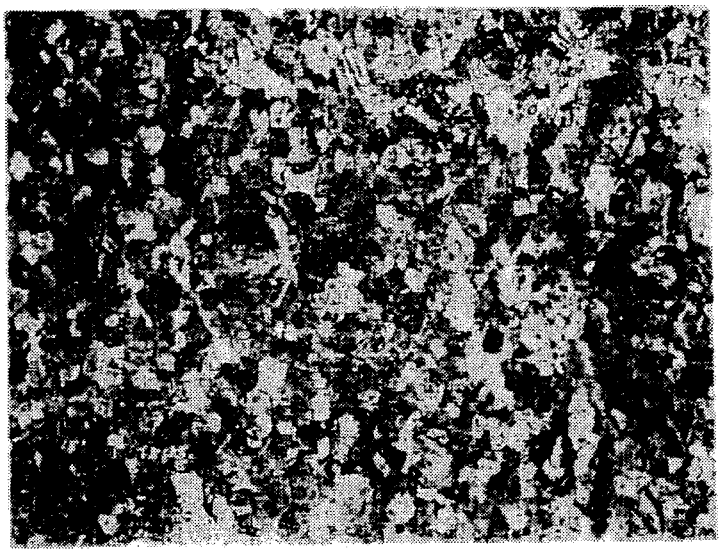

FIGS. 7*a* and 7*b* in turn show microscopic photographs of textures of the specimens Q and G when the copper-alloyed core is applied to the outer electrode 31. These photographs are obtained after carrying out an endurance test with the spark plug mounted on a six-cylinder, 2000 cc engine which runs at 6000 rpm with full throttle for 200 hours. It is found that the specimen G sufficiently prevents the metallic grains from getting coarse.

The additive metal of less than 0.5 weight percentages makes it impossible to precipitate enough amount of metallic grains, thus getting the grains coarse so as to decrease the mechanical strength of the copper-alloyed core 10*c* with the void developed in the core 10*c*.

The additive metal exceeding 1.5 weight percentages causes to reduce its thermal conductivity too low to put the outer electrode 31 into practical use.

In the outer electrode 31 shown in FIG. 8, the nickel-alloyed clad 10*n* contains 95 weight percent Ni, and including Cr, Si and Mn in appropriate percentage combination. The copper-alloyed core 10*c* contains an additive metal or metals in the range of 0.5–1.5 weight percentages selected from the group listed at Table 1, but the core 10*c* always contains at least one of chromium (Cr) and zirconium (Zr) as described hereinbefore. These additive metals forms a supersaturated solid solution with a copper metal, and precipitated from the copper phase, and substantially dispersed evenly. Specimens raised in Table 3 relate to the embodiment of the invention except specimens A, C, L, P, Q and R.

In the precipitation-hardened type copper specimens B and D–O listed in Table 3, the additive metals are precipitated from the copper phase, and evenly dispersed individually in the form of a single metal or intermetallic compound. For this reason, the copper-alloyed core 10*c* is improved in its mechanical strength, and the structures are maintained fine grain size. When these specimens B and D–O are incorporated into the outer electrode 31, it is found that no void is developed in the copper-alloyed core 10*c* after carrying out an endurance test with the spark plug mounted on a six-cylinder, 2000 cc engine which runs 1000 cycles alternately at 6000 rpm with full throttle for one minute and idle operation for one minute. It takes 2000–2600 cycles to deform the outer electrode away from the front end of the center electrode as indicated by the phantom line in FIG. 12, thus making it difficult to deform the outer electrode 31 to contribute to its extended service life.

Figure 9:
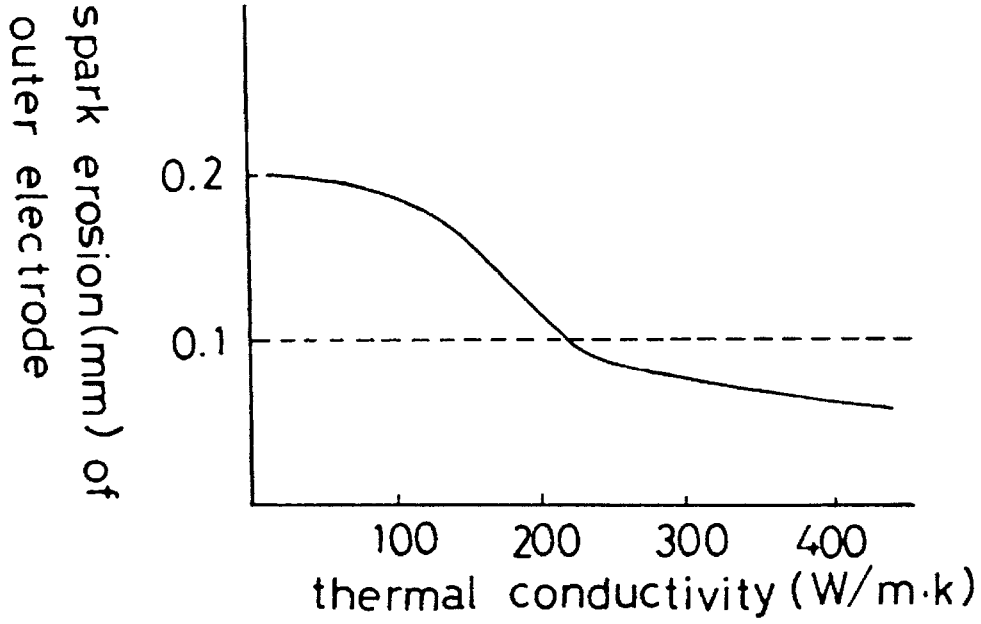
FIG. 9 is a graph showing the relationship between an amount of spark erosion and the thermal conductivity (W/m.k) obtained after carrying out an endurance test with the spark plug mounted on the engine.

FIG. 9 is a graph showing a relationship between the spark erosion (mm) and the thermal conductivity (W/m.k). The graph is obtained after carrying out an endurance test with the spark plug mounted on a six-cylinder, 2000 cc engine which runs at 6000 rpm with full throttle for 200 hours. As examplified by the specimens A–D, F–J and M–R in Table 3, it is found that the spark erosion of the outer electrode 31 decreases when the thermal conductivity of the core 10*c* exceeds 200 W/m.k obtained at the normal temperature by the laser-flash method.

The specimens B, D, F, G, H, I, J, M, N and O have superior properties in which no void is perceived in the copper-alloyed core 10*c*, and its thermal conductivity represents 200 W/m k or more when the specimens are subjected to a significantly higher frequency of the repeated heat cycles.

Figure 10:
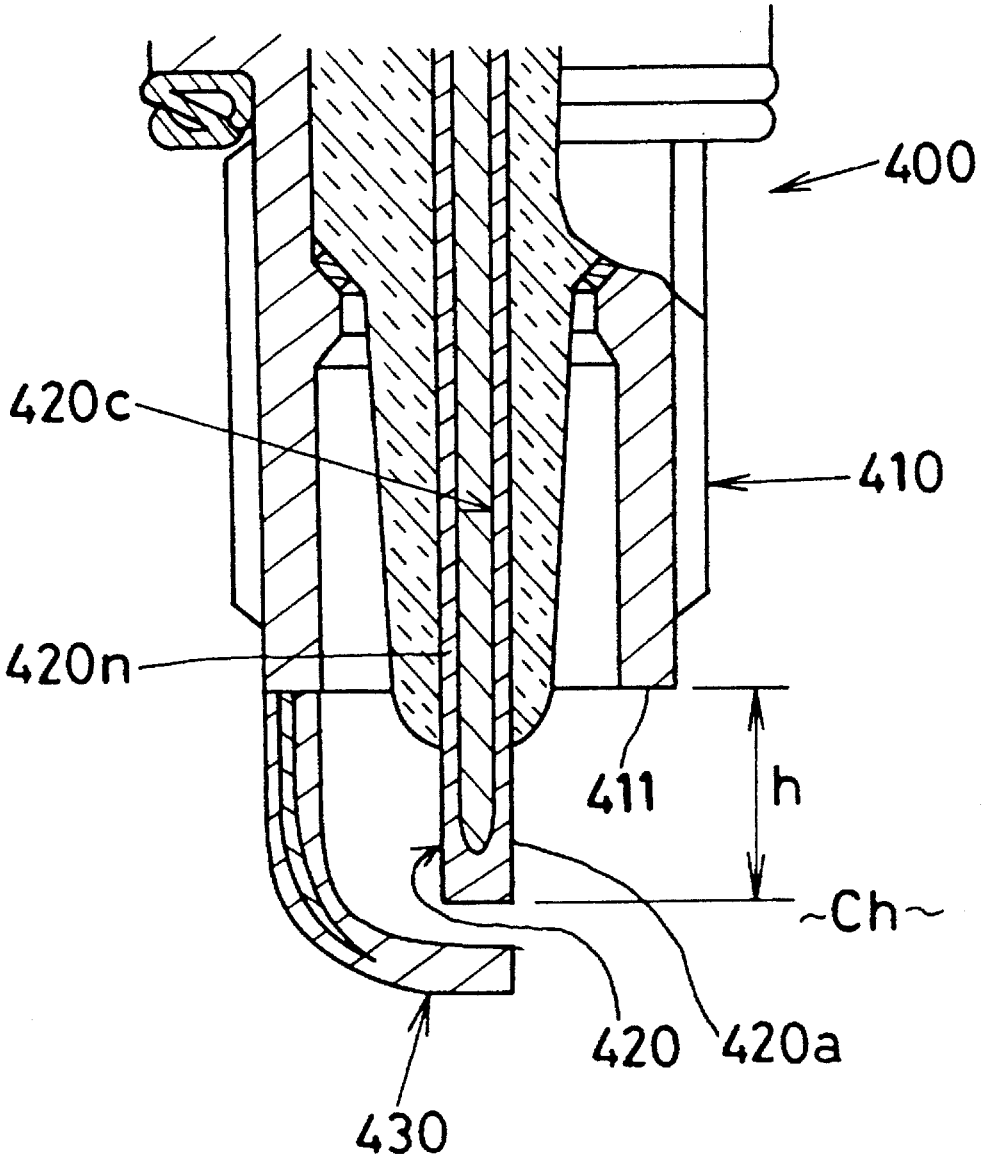
FIG. 10 is a longitudinal cross sectional view of a front portion of a projected type spark plug according to a modification of the invention.

As a modification of the invention in which a front portion 420*a* of a center electrode 420 of a spark plug 400 is protected longer into a combustion chamber (Ch) of an internal combustion engine, a copper-alloyed core 420*c* and a nickel-alloyed clad 420*n* are incorporated into the center electrode 420 as shown in FIG. 10. The front portion 420*a* projects beyond a front end 411 of a metallic shell 410 by a length (h) of 4.5–10.0 mm as opposed to the counterpart

TABLE 3

| | | outer electrode | | | | | | | | | | | | |
|---|---|---|---|---|---|---|---|---|---|---|---|---|---|---|
| | | additive metal (wt %) | | | | | | | | | | | number of heat cycles necessary to initiate | whether void |
| | | Cr | Zr | Si | Ti | Be | Ni | Co | Al | Fe | Sn | Zn | the deformation | develops |
| specimen | A | 0.3 | | | | | | | | | | | 1300 | developed |
| | B | 0.5 | | | | | | | | | | | 2000 | not developed |
| | C | 0.3 | 0.1 | | | | | | | | | | 1500 | developed |
| | D | 0.35 | 0.15 | | | | | | | | | | 2000 | not developed |
| | E | 0.35 | 0.15 | | 0.3 | | | | | | | | 2100 | not developed |
| | F | 0.6 | 0.2 | | | | | | | | | | 2200 | not developed |
| | G | 0.85 | 0.15 | 0.05 | | | | | | | | | 2300 | not developed |
| | H | 1.0 | 0.2 | | | | | | | | | | 2400 | not developed |
| | I | 1.0 | | | | | | | | | | | 2500 | not developed |
| | J | 1.1 | 0.25 | | | | | | | | | | 2500 | not developed |
| | K | 1.2 | 0.2 | | 0.1 | | | | | | | | 2600 | not developed |
| | L | 1.5 | 0.2 | | | | | | | | | | 2300 | not developed |
| | M | 0.6 | 0.2 | | | 0.1 | | | | | | | 2600 | not developed |
| | N | 0.6 | 0.2 | | | | 0.1 | | | | | | 2500 | not developed |
| | O | 0.6 | 0.2 | | | | | 0.1 | | | | | 2500 | not developed |
| | P | | | | | | | | | 1 | 0.5 | 0.5 | 1500 | developed |
| | Q | | | | | | | | 0.3 | | | | 1200 | developed |
| pure copper | R | | | | | | | | | | | | 700 | developed |

spark plug in which the extension length (h) is in the range of 3.0–4.0 mm. This protected type of spark plug makes it possible to ignite the air-fuel mixture gas at the center of the combustion chamber (Ch), thus rendering it advantageous in improving an ignitability in a lean burning system.

Figure 11B:
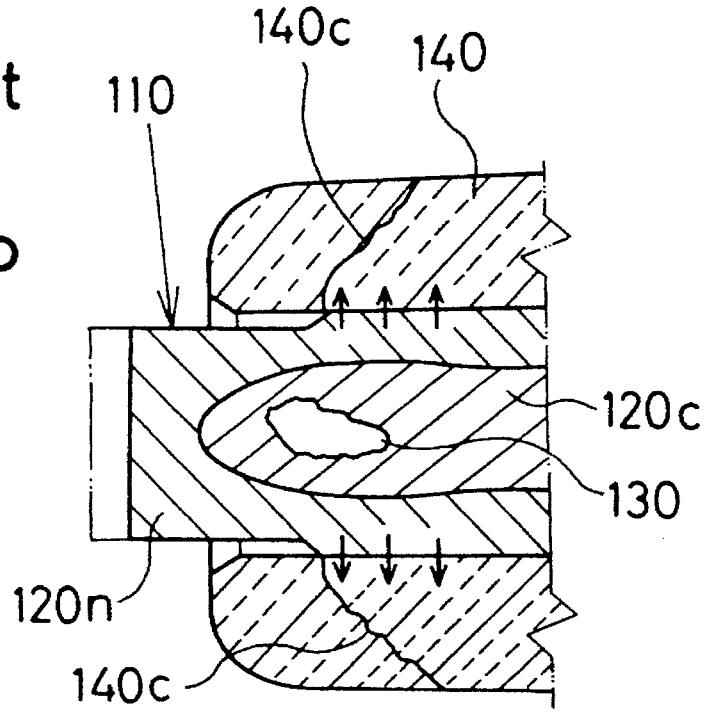
Prior Art Fig.11b
FIGS. 11*a* and 11*b* are cross sectional views of a front portion of a prior art spark plug to show how repeated thermal stress develops void to unfavorably deform a center electrode.
Figure 11A:
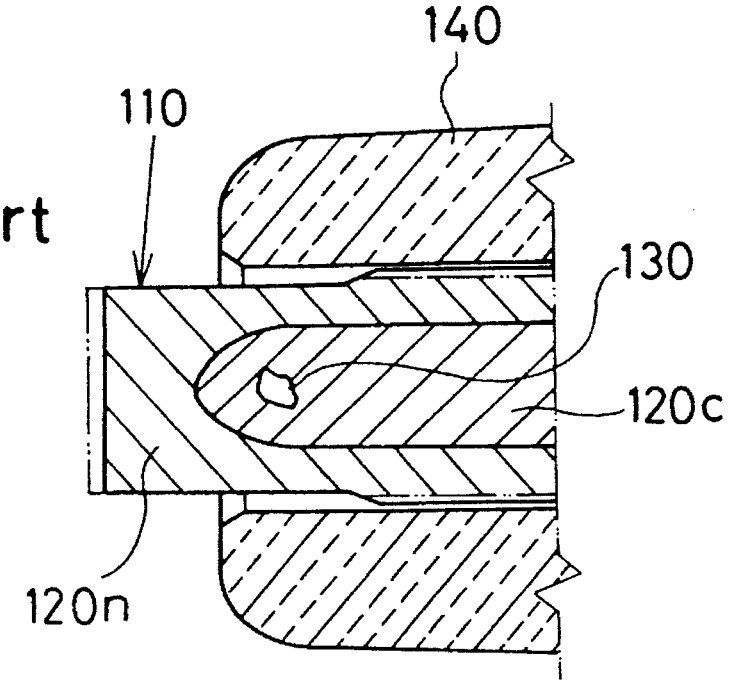
Prior Art Fig.11a
Figure 12:
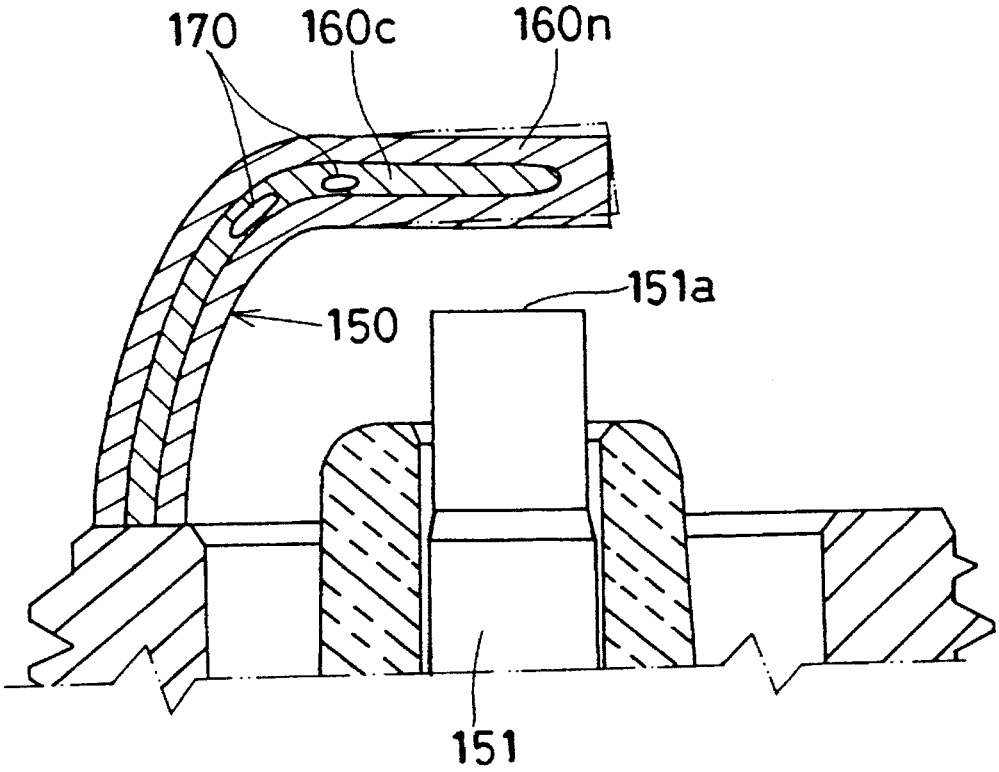
Prior Art Fig.12
FIG. 12 is a cross sectional view of the front portion of the prior art spark plug to show how the repeated thermal stress develops the void so as to unfavorably deform an outer electrode.

With the increase of the extension length (h), the front portion 420*a* of the center electrode 420 tends to be exposed to a larger amount of the combustion heat. Without using the copper-alloyed core 420*c* and the nickel-alloyed clad 420*n*, the larger amount of the combustion heat increases the thermal stress caused from the thermal expansional difference between the copper core and the nickel clad as shown in FIGS. 11*a*, 11*b* and 12.

With the use of the copper-alloyed core 420*c* and the nickel-alloyed clad 420*n*, the additive metal is evenly dispersed in the supersaturated solid solution precipitated from the copper phase, thus making it possible to prevent the metallic grains from getting coarse, and avoiding the cracks from developing at the grain boundary. This enables to prevent the loss of the mechanical strength in high temperature, and avoiding the development and growth of the void so as to prevent the unfavorable deformation in the center electrode 420 and the outer electrode 430.

While the invention has been described with reference to the specific embodiments, it is understood that this description is not to be construed in a limiting sense in as much as various modifications and additions to the specific embodiments may be made by skilled artisan without departing from the spirit and scope of the invention.

What is claimed is:

1. A spark plug, comprising:

a center electrode and an outer electrode, at least one of said center electrode and said outer electrode comprising a nickel-alloyed clad and a thermally conductive copper-alloyed core embedded in said nickel-alloyed clad;

said copper-alloyed core including an additive metal substantially evenly dispersed therein, said additive metal forming a supersaturated solid solution with a copper metal upon precipitation in said copper metal of said additive metal or an intermetallic compound from a copper phase;

wherein said additive metal is selected from the group consisting of chromium, zirconium and a combination thereof, said additive metal is present in said copper-alloyed core in an amount in the range of 0.5 to 1.5 weight percent and said additive metal has a precipitated particle size of less than 10 μm, and said copper-alloyed core has a thermal conductivity of at least 200 W/m.k at normal temperature when measured by a laser-flash method.

2. A spark plug, comprising:

a center electrode and an outer electrode, at least one of said center electrode and said outer electrode comprising a nickel-alloyed clad and a thermally conductive copper-alloyed core embedded in the nickel-alloy clad;

said copper-alloyed core including a ceramic powder substantially evenly dispersed in a copper metal in an amount in the range of 0.2 to 1.5 weight percent;

wherein said ceramic powder is alumina or magnesia, and said copper-alloyed core has a thermal conductivity of at least 200 W/m.k at normal temperature when measured by a laser-flash method.

* * * * *